United States Patent [19]

Levinrad

[11] 4,252,323

[45] Feb. 24, 1981

[54] BOARD GAME WITH COLOR TILES AND LETTER TILES

[76] Inventor: Maxim D. Levinrad, P.O. Box 7275, Johannesburg, South Africa, 2000

[21] Appl. No.: 968,784

[22] Filed: Dec. 12, 1978

[30] Foreign Application Priority Data

Dec. 13, 1977 [ZA] South Africa ..... 77/7420

[51] Int. Cl.[3] ..... A63F 3/00

[52] U.S. Cl. ..... 273/272

[58] Field of Search ..... 273/157 R, 272, 275; D21/24, 34, 36

[56] References Cited

U.S. PATENT DOCUMENTS

| | | | |
|---|---|---|---|
| D. 91,967 | 1/1934 | Saxmann | D21/34 |
| D. 138,407 | 8/1944 | Haynes | D21/24 |
| D. 225,245 | 11/1972 | Berger | D21/24 |
| 2,037,966 | 4/1936 | Dailey | 273/157 R |
| 2,752,158 | 6/1956 | Brunot | 273/272 |
| 3,396,972 | 8/1968 | Smith | 273/272 |

FOREIGN PATENT DOCUMENTS

| | | | |
|---|---|---|---|
| 258166 | 9/1926 | United Kingdom | 273/272 |
| 908792 | 10/1962 | United Kingdom | 273/272 |
| 1219839 | 1/1971 | United Kingdom | 273/272 |

OTHER PUBLICATIONS

Scrabble Brand Crossword Games with Grid. 1977 Selchow & Righter Games Catalog.

*Primary Examiner*—Harland S. Skogquist
*Attorney, Agent, or Firm*—Young & Thompson

[57] ABSTRACT

A game in the course of which words are formed by juxtaposing letter carrying tiles in cross word fashion, each word either starting adjacent a colored panel on a board on which the game is played or adjacent a colored tile already placed on the board or crossing a word already on the board and each word having a colored panel behind its terminal letter such that when the game is over, the board has the appearance of a true cross word puzzle. Scores are achieved according to the length of words formed and crossed and the positioning of colored tiles in the best available positions. Also included in the invention is apparatus for use in playing the game.

2 Claims, 2 Drawing Figures

BOARD GAME WITH COLOR TILES AND LETTER TILES

Figure 1:
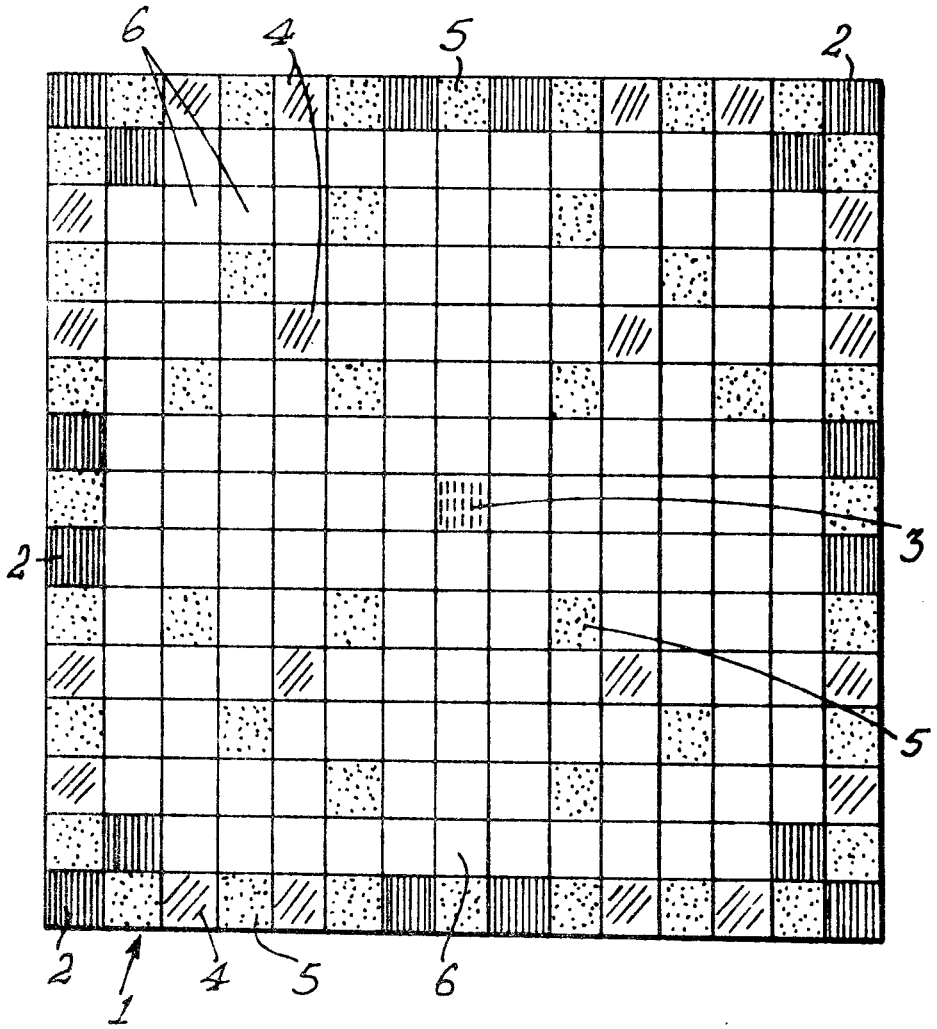
Figure 2:
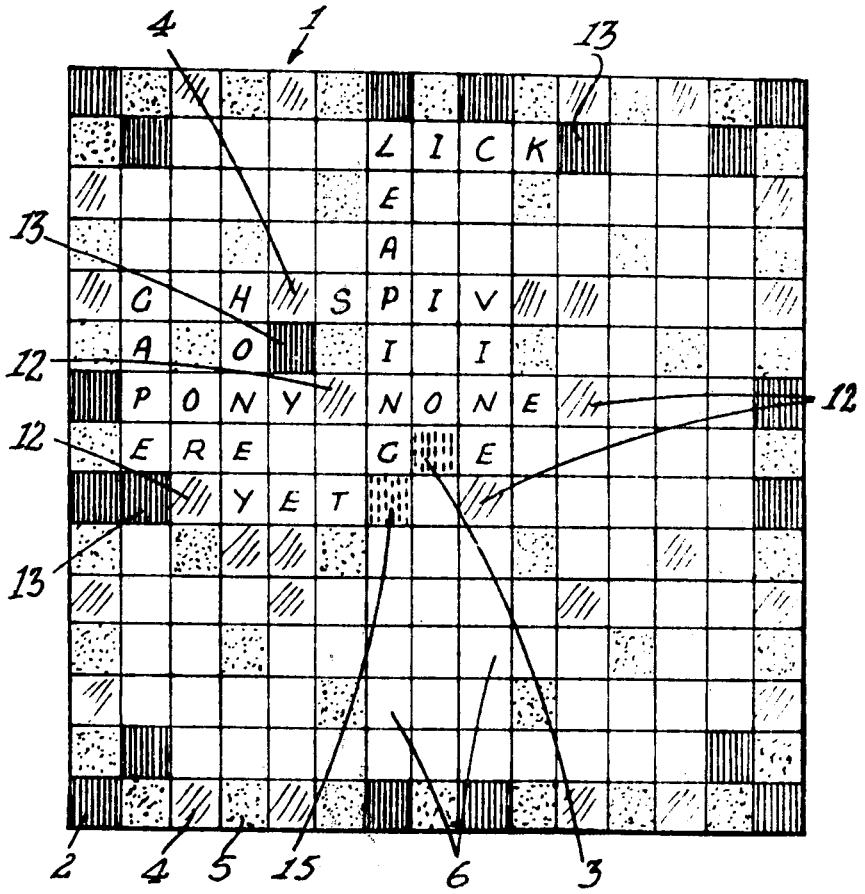

THIS invention relates to board games and its origins lie in conventional cross word puzzles.

In the arrangement of the invention the concept of the cross word puzzle is linked to the use of letters or other suitable insignia on tiles as in games such as "Scrabble" and these tiles are then assembled on a panelled board in the process of playing the game.

The concept of the invention is best illustrated by means of a full description of one embodiment of the invention and the steps by which the game is actually played.

For purposes of describing the game two illustrations are used the one being a simple diagram of a typical board employed and labelled "A" and the other being the board at a stage where the game has been in progress for some time. This latter illustration is labelled "B".

The word "tile" in this specification is intended to include cards, slabs and blocks of natural or synthetic material and is preferably substantially square in shape and of a substantial area relative to its thickness.

The board itself is panelled as shown with a well defined border 1 made up of panels of selected colours. Panels marked 2 are of red, panels 3 of purple, panels 4 of black and panels 5 of grey. Within the framework of the border 1 similar coloured panels are randomly located amongst neutral panels 6.

In this specification reference is made to coloured panels and neutral panels. Reference is also made to coloured tiles of particular colours. The colour features neither forms part of the invention nor is it intended to impose limitations on the invention. The reference to colour is merely in the nature of a distinguishing feature. As will become apparent later on in this specification the neutral panels constitute the actual playing zone of the board whilst the coloured panels define start-off points for the formation of words in the course of the game. Letters are preferably provided on tiles of a neutral colour such as white, cream or the like and the coloured tiles, as will be seen, provide for an increase in the scoring value of a word formed by juxtaposing a plurality of letter carrying tiles. It will be appreciated that the letter carrying tiles may be of a natural colour, such as red, and likewise the colours of the "coloured panels" on the board as well as the colour of the coloured tiles may be changed without departing from the invention.

Preferably the coloured panels are raised above the general squared area defined within border 1 so that when a game has been completed with all the neutral panels 6 of the board overlaid with tiles a flush surface is provided. The raised panels may be provided by laminating coloured tiles onto the appropriate panels on the board.

Separate tiles matching in size the panels previously referred to are provided for use by the players and in the game under consideration the disposition of the letter carrying tiles and values of the coloured tiles are as follows:

| (a) COLOURED TILES | |
|---|---|
| Purple | 2 |
| Red | 10 |

-continued

| | |
|---|---|
| Black | 25 |
| Grey | 20 |
| Total | 57 |

| (b) LETTER TILES | | | |
|---|---|---|---|
| A | 11 | N | 7 |
| B | 3 | O | 10 |
| C | 3 | Q | 1 |
| D | 5 | R | 8 |
| E | 15 | S | 6 |
| F | 3 | T | 8 |
| G | 4 | U | 5 |
| H | 4 | V | 3 |
| I | 11 | W | 3 |
| J | 2 | X | 1 |
| K | 2 | Y | 3 |
| L | 6 | Z | 1 |
| M | 3 | | |
| | | Total | 131 |

The game may conveniently be played by from two to six persons although it may be played by one person. Play consists of forming words on the board in the fashion of conventional cross word puzzles and when all the open squares are occupied the game is at an end. The development of high scores is achieved in various ways, such as by positioning the best available coloured tile after a word formed on the board, by the number of letters placed on the board in the formation of a word, by crossing words already on the board where possible, and by placing coloured tiles in the best positions available when it is not possible for a player to form a word. The tactics of the game will be understood in the description of play which follows.

Play begins by turning all the tiles, both coloured and letters, face down before the players in a well shuffled state. The starter may be selected by allowing each player to draw a tile from the stock pile and the player drawing the letter nearest the letter "A" begins. Each player starts with a predetermined number of tiles which for convenience may be eleven.

The player to start combines as many letters as he can to form a word which is located on the board in the manner illustrated but, save as set out in the next paragraph, always starting adjacent a coloured panel on the board. The starting coloured panel may be one of the panels forming the border 1 or it may be one of the coloured panels within the perimeter of the border. It is also essential that a coloured tile must be positioned at the end of a word formed by the player or the final letter in such a word must have a coloured panel behind it. The end coloured tile may be a tile already on the board or a tile placed in position by the current player. This end coloured tile (or panel) indicates the total or premium points acquired by the player.

The starting player completes his turn by announcing his score and drawing as many tiles from the pool as he has placed on the board, so that he again has 11 tiles in front of him.

Play passes to the left, and the second player, and then each in his turn, makes a new word. As with the first player this word must be placed on the board always starting from a coloured panel or a coloured tile already on the board unless his new word crosses an existing word or words, cross word fashion. In this case he does not need to start from a coloured panel or tile, and the word or words he crosses count towards his score. The new word formed must always have a coloured tile or a coloured panel at the end of it, which may have been on the board or has been placed from his hand in the case of a coloured tile.

A new word may only be formed in one direction and a new word may be placed adjacently to an existing word only if all adjoining letters also form complete words. All adjacent letters must form complete words, and at no stage may an incomplete word appear on the board. It may happen that when a word is formed with the coloured tile at the end of it, an additional word may be formed which may not have a coloured tile after it as may be seen in illustration "B" in the case of the word "ERE". This is considered an open word and letters may be added to it to form a new word. The player will then receive the benefit of these letters as well as that of any words which the new word crosses.

Only one coloured tile may be placed on the board in any one turn and no tile may be moved once it has been placed on the board. No player may miss a turn and if he does not place a word on the board, he must place a coloured tile on any empty square on the board. The player receives points for this according to the colour of the tile placed. If the coloured tile is placed on a square which is closed in on all four sides, (known as a filler tile), extra points are received. If a coloured tile is not placed in the above manner, then the player must place a letter tile face down on an empty square. The player receives no points for this. Only one coloured tile, or face down letter tile may be placed in any one turn.

No player may change his tiles at any time, and he may only obtain new tiles from the pool by drawing the number of tiles placed on the board in his turn. Words found in a standard dictionary may be used and play continues until the cross word is completed; in other words, until every space has been used up. The player filling the last space receives a bonus.

A suitable form of scoring is as follows:

1. (a) Each letter in a new word formed plus each letter in words crossed count for 1 point.

(b) These points are multiplied according to the colour of the tile at the end of the new word as follows:

Grey×1
Black×2
Red×3
Purple×5

2. Coloured tiles placed on their own (when a word has not been made) receive points as follows:

Grey 1 point
Black 2 points
Red 3 points
Purple 5 points

Where a coloured tile is used as a "filler tile", (i.e. where the square on which it is placed is closed in on all four sides), its value is multiplied by 5 i.e. -

Grey 5 points
Black 10 points
Red 15 points
Purple 25 points

3. The player filling the last empty square receives a bonus of 25 points, in addition to points scored.

In illustration "B" we see the development of play over twelve moves where four players are involved, the play proceeding stage-by-stage as indicated hereunder and coloured tiles are represented as follows:

Grey [11] BLack [12] Red [13] Purple [15]

Played with 4 players, each received starting hands as follows:

| | | | | | |
|---|---|---|---|---|---|
| (a) D,N,O,O,P,U,Y, | [12] | [12] | [12] | [11] | |
| (b) E,G,H,I,N,O,P,W,Y, | | [12] | [12] | | |
| (c) A,E,G,S,U,V, | [13] | [12] | [11] | [11] | [11] |
| (d) C,E,E,I,K,T,Z, | [15] | [13] | [12] | [11] | |

Round 1

| | |
|---|---|
| (a) PONY & Black tile<br>Draws D,R, [12] [12] [11] | 8 points (PONY × 2) |
| (b) HONEY & black tile<br>Draws A,E,L,S, [12] | 18 points (HONEY & PONY × 2) |
| (c) GAPE & red tile<br>Draws I,S,X,Y, | 24 points (GAPE: PONY × 3) |
| (d) YET & Purple tile<br>Draws B,H,J, | 40 points (YET: HONEY × 5) |

Round 2

| | |
|---|---|
| (a) OR & black tile<br>Draws G [13] | 18 points (OR:PONY: ERE × 2) |
| (b) LEAPING (Ends with purple on board)<br>Draws B,C,E,N,O, [12] [11] | (LEAPING × 5) 35 points |
| (c) SPIV & Black tile<br>Draws O, [12] [12] [12] | 22 points (SPIV: LEAPING × 2) |
| (d) LICK & red tile<br>Draws D,F,H,I. | 33 points (LICK: LEAPING × 3) |

Round 3

| | |
|---|---|
| Round 3 | |
| (a) Places red tile above Y of PONY (Filler tile)<br>Draws F | 15 points |
| (b) NONE & black tile<br>Draws L,N, [13] [11] | 22 points (NONE: LEAPING × 2) |
| (c) Places black tile below E of YET (Filler)<br>Draws N | 10 points |
| (d) VINE & Black tile<br>Draws L,O, [13] | 24 points (VINE:SPIV NONE × 2) |

In drawing "B" the coloured tiles placed on the board during the three rounds described above are respectively marked as follows:

Black 12,
Red 13 and
Purple 15.

In order to prevent accidental movement of letters on the board thereby causing words already formed to become out of alignment, the demarcations on the board may consist of or include rib formations thus constituting a plurality of recesses on the board into which the letter carrying tiles and coloured tiles may be neatly accommodated in reasonable stable condition.

The arrangement set out above may be varied considerably within the general scope of the invention. Protection is sought in respect of the game itself and for the novel elements employed therein. In respect of the game the kit as a whole will comprise the board plus the various tiles needed to play the game. Protection is also sought for the special type of board needed in this application.

We claim:

1. A board game comprising:

a game board demarcated to define a plurality of substantially equally dimensioned panels thereon, the peripheral panels on the board and some of the inner panels being raised above the inner panels which constitute the playing surface of the board, the raised panels being distinguishably colored and classified into at least two sets of distinguishable colors, each colored set being ascribed a certain bonus value;

a plurality of tiles dimensioned to be neatly receivable on the panels of the playing surface of the board, the tiles being classified into two main sets, namely a first set of tiles, each of which carries a letter of the alphabet, and a second set of colored tiles, the colored tiles being classified into at least two subsets of distinguishably colored tiles, the tiles of each set being ascribed a certain bonus value;

the arrangement being such that letter tiles may be placed in juxtaposition on the board to form words, the number of tiles being such that at the end of the game the tiles and raised panels constitute a substantially flat surface having the appearance of a completed crossword game, there being at that time no empty panels on the board.

2. The board game of claim 1 wherein there are four types of colored raised panels each characterized by a different color and four types of similarly colored tiles.

* * * * *